US008350473B2

(12) United States Patent
Lee et al.

(10) Patent No.: US 8,350,473 B2
(45) Date of Patent: Jan. 8, 2013

(54) PLASMA DISPLAY PANEL HAVING A PHOSPHOR LAYER INCLUDING A PHOSPHOR MATERIAL AND AN ADDITIVE MATERIAL

(75) Inventors: Jihoon Lee, Gumi (KR); Heekwon Kim, Gumi (KR); Jeonghyun Hahm, Gumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/304,120

(22) PCT Filed: Feb. 28, 2008

(86) PCT No.: PCT/KR2008/001171

§ 371 (c)(1),
(2), (4) Date: Sep. 8, 2010

(87) PCT Pub. No.: WO2009/061032

PCT Pub. Date: May 14, 2009

(65) Prior Publication Data

US 2010/0327732 A1 Dec. 30, 2010

(30) Foreign Application Priority Data

Nov. 5, 2007 (KR) ..... 10-2007-0111919

(51) Int. Cl.
*H01J 11/00* (2012.01)
*H01J 17/00* (2006.01)
*H01J 17/49* (2012.01)

(52) U.S. Cl. ..... 313/567; 313/586; 313/581; 313/582; 313/583; 313/585; 313/584

(58) Field of Classification Search ..... None
See application file for complete search history.

(56) References Cited

U.S. PATENT DOCUMENTS

| | | | | |
|---|---|---|---|---|
| 6,784,617 | B2 * | 8/2004 | Jeong et al. | 313/586 |
| 7,492,101 | B2 * | 2/2009 | Yoon | 313/586 |
| 2004/0080271 | A1 * | 4/2004 | Aoki et al. | 313/582 |
| 2005/0093450 | A1 * | 5/2005 | Yoon | 313/586 |
| 2008/0100539 | A1 * | 5/2008 | Ryu et al. | 345/72 |

FOREIGN PATENT DOCUMENTS

| | | |
|---|---|---|
| CN | 1612283 A | 5/2005 |
| JP | 2000-243302 | 9/2000 |

(Continued)

OTHER PUBLICATIONS

PCT Notification of Transmittal of the International Search Report and Written Opinion for Application No. PCT/KR2008/001171 mailed Jul. 30, 2008 (11 pages). Chinese Office Action dated Aug. 23, 2010 for Application No. 200880000935.2, in English translation, 7 pages.

*Primary Examiner* — Natalie Walford
(74) *Attorney, Agent, or Firm* — Fish & Richardson P.C.

(57) ABSTRACT

A plasma display panel is disclosed. The plasma display panel includes a front substrate, a rear substrate positioned to be opposite to the front substrate, a barrier rib positioned between the front substrate and the rear substrate to partition a discharge cell, and a phosphor layer positioned in the discharge cell. The phosphor layer includes a phosphor material and an additive material. The phosphor layer includes a red phosphor layer emitting red light, a green phosphor layer emitting green light, and a blue phosphor layer emitting blue light. A thickness of the blue phosphor layer is larger than a thickness of the red phosphor layer.

5 Claims, 10 Drawing Sheets

FOREIGN PATENT DOCUMENTS

| | | | |
|---|---|---|---|
| JP | 2001-135241 | | 5/2001 |
| JP | 2002-324492 | | 11/2002 |
| JP | 2004-207047 | A | 7/2004 |
| KR | 1020000003022 | A | 1/2000 |
| KR | 1020050114075 | A | 12/2005 |
| WO | WO2009/061032 | | 5/2009 |

* cited by examiner

| $t_2/t_1$ | Color representability |
|---|---|
| 0.95 | ○ |
| 1.0 | ◎ |
| 1.01 | ◎ |
| 1.05 | ◎ |
| 1.15 | ◎ |
| 1.25 | ◎ |
| 1.26 | ◎ |
| 1.3 | ○ |
| 1.32 | ○ |
| 1.4 | X |

| | |
|---|---|
| ◎ | : Excellent |
| ○ | : Good |
| X | : Bad |

Figure 8

| | Comparative example | Experimental example 1 | Experimental example 2 | Experimental example 3 |
|---|---|---|---|---|
| Firing voltage | 135V | 128V | 129V | 127V |
| Luminance | 170(cd/$m^2$) | 176(cd/$m^2$) | 178(cd/$m^2$) | 177(cd/$m^2$) |
| Contrast ratio | 55:1 | 60:1 | 58:1 | 61:1 |

PLASMA DISPLAY PANEL HAVING A PHOSPHOR LAYER INCLUDING A PHOSPHOR MATERIAL AND AN ADDITIVE MATERIAL

TECHNICAL FIELD

This document relates to a plasma display panel.

BACKGROUND ART

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

DISCLOSURE OF INVENTION

Reference will now be made in detail embodiments of the invention examples of which are illustrated in the accompanying drawings.

FIG. 1 is a diagram for explaining a structure of a plasma display panel.

As shown in FIG. 1, a plasma display panel 100 may include a front substrate 101, on which a scan electrode 102 and a sustain electrode 103 are positioned parallel to each other, and a rear substrate 111 on which an address electrode 113 is positioned to intersect the scan electrode 102 and the sustain electrode 103.

An upper dielectric layer 104 may be positioned on the scan electrode 102 and the sustain electrode 103 to limit a discharge current of the scan electrode 102 and the sustain electrode 103 and to provide electrical insulation between the scan electrode 102 and the sustain electrode 103.

A protective layer 105 may be positioned on the upper dielectric layer 104 to facilitate discharge conditions.

A lower dielectric layer 115 may be positioned on the address electrode 113 to cover the address electrode 113 and to provide electrical insulation of the address electrodes 113.

Barrier ribs 112 of a stripe type, a well type, a delta type, a honeycomb type, and the like, may be positioned on the lower dielectric layer 115 to partition discharge spaces (i.e., discharge cells). A red discharge cell emitting red (R) light, a blue discharge cell emitting blue (B) light, and a green discharge cell emitting green (G) light, and the like, may be positioned between the front substrate 101 and the rear substrate 111.

FIG. 2 is a diagram for explaining a thickness of a phosphor layer in each discharge cell.

A phosphor layer 114 may be positioned inside the discharge cells partitioned by the barrier ribs 112 to emit visible light for an image display during an address discharge. For instance, red, green, and blue phosphor layers 114R, 114G, and 114B that emit red, green, and blue light, respectively, may be positioned inside the discharge cells.

As shown in FIG. 2, a thickness t2 of the blue phosphor layer 114B inside the blue discharge cell in (c) is larger than a thickness t1 of the red phosphor layer 114R inside the red discharge cell in (a). A thickness t3 of the green phosphor layer 114G inside the green discharge cell in (b) may be equal to or different from the thickness t1 of the red phosphor layer 114R.

When a width of the red discharge cell in a direction parallel to the scan electrode or the sustain electrode is T, the thickness t1 of the red phosphor layer 114R may be a thickness measured at a location corresponding to one half (T/2) of the width T of the red discharge cell.

When a width of the blue discharge cell in a direction parallel to the scan electrode or the sustain electrode is T' the thickness t2 of the blue phosphor layer 114B may be a thickness measured at a location corresponding to one half (T'/2) of the width T' of the blue discharge cell.

As above, the fact that the thickness t2 of the blue phosphor layer 114B is larger than the thickness t1 of the red phosphor layer 114R means that the amount of blue phosphor material coated on the blue discharge cell is more than the amount of red phosphor material coated on the red discharge cell.

Accordingly, because the amount of blue light emitted from the blue discharge cell increases, a color temperature of a displayed image can be improved.

FIGS. 3 and 4 are diagrams for explaining a relationship between a thickness of a red phosphor layer and a thickness of a blue phosphor layer.

FIG. 3 shows a graph measuring a color temperature of an image displayed when a ratio t2/t1 of the thickness t2 of the blue phosphor layer to the thickness t1 of the red phosphor layer changes from 0.95 to 1.4 in a state where the thickness t1 of the red phosphor layer is fixed at approximately 13 μm.

As shown in FIG. 3, when the ratio t2/t1 ranges from 0.95 to 1.0, the color temperature has a relatively low value of approximately 6,770K to 6,800K.

When the ratio t2/t1 is 1.01; the color temperature increases to approximately 6,860K.

When the ratio t2/t1 is 1.05, the color temperature is approximately 7,250K.

When the ratio t2/t1 ranges from 1.1 to 1.26, the color temperature has a relatively high value of approximately 7,320K to 7,520K.

When the ratio t2/t1 is equal to or more than 1.3, the color temperature has a value equal to or more than approximately 7,550K.

As the ratio t2/t1 increases, the amount of blue light generated in the blue discharge cell increases. Hence, the color temperature increases. On the other hand, when the ratio t2/t1 is equal to or more than 1.35, an increase width of the color temperature is small even if the ratio t2/t1 increases.

FIG. 4 shows a table evaluating a color representability of an image displayed when the ratio t2/t1 of the thickness t2 of the blue phosphor layer to the thickness t1 of the red phosphor layer changes from 0.95 to 1.4. In FIG. 4, ◎ indicates that the color representability is excellent; ○ indicates that the color representability is good; and X indicates that the color representability is bad.

As shown in FIG. 4, when the ratio t2/t1 is 0.95, the color representability is good (○). When the ratio t2/t1 ranges from 1.3 to 1.32, the color representability is good (○).

When the ratio t2/t1 ranges from 1.0 to 1.26, the color representability is excellent (◎). This means that red and blue can be clearly represented because the ratio t2/t1 is proper.

On the other hand, when the ratio t2/t1 is equal to or more than 1.4, red representability may be reduced because the thickness t1 of the red phosphor layer is excessively smaller than the thickness t2 of the blue phosphor layer. Hence, the representability of all colors of an image may be reduced.

Considering the description of FIGS. 3 and 4, the ratio t2/t1 of the thickness t2 of the blue phosphor layer to the thickness t1 of the red phosphor layer may lie substantially in a range between 1.01 and 1.32 or between 1.05 and 1.26.

FIG. 5 is a diagram for explaining non-uniformity of discharges generated in discharge cells.

As shown in (a) and (b) of FIG. 5, because different phosphor layers positioned in red, green, and hue discharge cells 400, 410, and 420 each have a different electrical characteristic, the red, green, and blue discharge cells 400, 410, and 420 may have different discharge occurring time points.

For instance, it is assumed that (Y, Gd)BO:Eu used as a red phosphor material emitting red light is positioned in the red discharge cell 400, Zn2Si04:Mn+2 or YBO3:Tb+3 used as a green phosphor material emitting green light is positioned in the green discharge cell 410, and (Ba, Sr, Eu)MgAl10O17 used as a blue phosphor material emitting blue light is positioned in the hue discharge cell 420. (Y, Gd)BO:Eu, Zn2Si04:Mn+2 or YBO3:Tb+3, and (Ba, Sr, Eu)MgAl10O17 may have a different electrical characteristic such as permittivity, secondary electron emission coefficient, electron affinity.

Accordingly, as shown in (a) of FIG. 5, a discharge in the red discharge cell 400 may start to occur earlier than discharges in the green and blue discharge cells 410 and 420. As shown in (b) of FIG. 5, the discharges generated in the red, green, and blue discharge cells 400, 410, and 420 are diffused, and the red, green, and blue discharge eels 400, 410, and 420 may have a different time point when a peak luminance of the discharge is achieved.

As above, the phosphor layer 114 may include an additive material (for example, MgO material) so as to remove a difference among discharge characteristics of the discharge cells.

FIG. 6 is a diagram for explaining a phosphor layer including particles of an additive material.

As shown in FIG. 6, the phosphor layer 114 includes particles 1000 of a phosphor material and particles 1010 of an additive material.

The particles 1010 of the additive material can improve a discharge response characteristic between the scan electrode and the address electrode or between the sustain electrode and the address electrode. This will be below described in detail.

In case that the phosphor layer 114 includes an additive material such as MgO material as in the present invention, particles of the additive material act as a catalyst of a discharge. Hence, a discharge can stably occur between the scan electrode and the address electrode at a relatively low voltage. Accordingly, before a strong discharge occurs at a relatively high voltage in a specific portion of the phosphor layer, on which charges are concentratedly accumulated, a discharge can occur at a relatively low voltage in a portion of the phosphor layer, on which the particles of the additive material are positioned. Hence, discharge characteristics of each discharge cell can be uniform. This is caused by a reason why the additive material has a high second electron emission coefficient.

In other words, since each discharge cell can have a substantially equal discharge start time point and a substantially equal peak luminance occurring time point, discharge uniformity can be improved. This is because particles of the additive material having a relatively high second electron emission coefficient emit a large amount of electrons during a discharge.

The additive material may include at least one of magnesium oxide (MgO), zinc oxide (ZnO), silicon oxide ($SiO_2$), titanium oxide ($TiO_2$), yttrium oxide ($Y_2O_3$), aluminum oxide ($Al_2O_3$), lanthanum oxide ($La_2O_3$), europium oxide (EuO), cobalt oxide, iron oxide, or CNT (carbon nano tube). It may be advantageous that the additive material is MgO material.

At least one of the particles 1000 of the phosphor material on the surface of the phosphor layer 114 may be exposed in a direction toward the center of the discharge cell. For instance, since the particles 1010 of the additive material are disposed between the particles 1000 of the phosphor material on the surface of the phosphor layer 114, the particles 1000 of the phosphor material may be exposed.

As described above, when the particles 1010 of the additive material are disposed between the particles 1000 of the phosphor material, a discharge response characteristic between the scan electrode and the address electrode or between the sustain electrode and the address electrode can be improved. Further, since the surface area of the particles 1000 of the phosphor material covered by the particles 1010 of the additive material may be minimized, a reduction in a luminance can be prevented.

A thickness T1 at the side of the phosphor layer 114 is larger than a thickness T2 at a lower portion of the phosphor layer 114. When a height of the barrier rib 112 is H, the thickness T1 is a thickness measured at a location corresponding to one half (H/2) of the height H of the barrier rib 112 in a direction parallel to the rear substrate 111. When a pitch of the discharge cell is L, the thickness T2 is a thickness measured at a location corresponding to one half (L/2) of the pitch L of the discharge cell in a direction crossing with the rear substrate 111.

As above, when the thickness T1 at the side of the phosphor layer 114 is larger than the thickness T2 at a lower portion of the phosphor layer 114, the amount of visible light generated in the phosphor layer 114 increases. Hence, a luminance of a displayed image can be improved.

FIG. 7 illustrates an example of a method of manufacturing a phosphor layer including particles of an additive material.

As shown in FIG. 7, first, a powder of an additive material is prepared in step S1100. For instance, a gas oxidation process is performed on Mg vapor generated by heating Mg to form a powder of MgO.

Next, the prepared additive power is mixed with a solvent in step S1110. For instance, the resulting MgO powder is mixed with methanol to manufacture an additive paste or an additive slurry. A binder may be added so as to adjust a viscosity of the additive paste or the additive slurry. Subsequently, the additive paste or the additive slurry is coated on the phosphor layer in step S1120. In this case, a viscosity of the additive paste or the additive slurry is adjusted so that particles of the additive material are smoothly positioned between particles of the phosphor material.

Subsequently, a dry process or a firing process is performed in step S1130. Hence, the solvent mixed with the additive material is evaporated to form the phosphor layer of FIG. 6.

FIGS. 8 and 9 are diagrams for explaining an effect of an additive material of a phosphor layer.

FIG. 8 is a table showing a firing voltage, a luminance of a displayed image, and a bright room contrast ratio of each of a comparative example and experimental examples 1, 2 and 3. The bright room contrast ratio measures a contrast ratio in a state where an image with a window pattern occupying 45% of the screen size is displayed in a bright room. The firing voltage is a firing voltage measured between the scan electrode and the address electrode.

In the comparative example, the phosphor layer does not include an additive material.

In the experimental example 1, the phosphor layer includes MgO of 3% based on the volume of the phosphor layer as an additive material.

In the experimental example 2, the phosphor layer includes MgO of 9% based on the volume of the phosphor layer as an additive material.

In the experimental example 3, the phosphor layer includes MgO of 12% based on the volume of the phosphor layer as an additive material.

In the comparative example, the firing voltage is 135V, and the luminance is 170 cd/m$^2$.

In the experimental examples 1, 2 and 3, the firing voltage is 127V to 129V lower than the firing voltage of the comparative example, and the luminance is 176 cd/m$^2$ to 178 cd/m$^2$ higher than the luminance of the comparative example.

Because the particles of the MgO material as the additive material in the experimental examples 1, 2 and 3 act as a catalyst of a discharge, the firing voltage between the scan electrode and the address electrode is lowered. Furthermore, in the experimental examples 1, 2 and 3, because an intensity of a discharge generated at the same voltage as the comparative example increases due to a fall in the firing voltage, the luminance further increases.

While the bright room contrast ratio of the comparative example is 55:1, the bright room contrast ratio of the experimental examples 1, 2 and 3 is 58:1 to 61:1. As can be seen from FIG. 8, a contrast characteristic of the experimental examples 1, 2 and 3 is more excellent than that of the comparative example.

In the experimental examples 1, 2 and 3, a discharge uniformly occurs at a lower firing voltage than that of the comparative example, and thus the amount of light during a reset period is relatively small.

In FIG. 9, (a) is a graph showing the amount of light in the experimental examples 1, 2 and 3, and (b) is a graph showing the amount of light in the comparative example.

As shown in (b) of FIG. 9, because an instantaneously strong discharge occurs at a relatively high voltage in the comparative example not including the MgO material, the amount of light may instantaneously increase. Hence, the contrast characteristics may worsen.

As shown in (a) of FIG. 9, because a discharge occurs at a relatively low voltage in the experimental examples 1, 2 and 3 including the MgO material, a weak reset discharge continuously occurs during a reset period. Hence, a small amount of light is generated, and the contrast characteristics can be improved.

FIG. 10 is a diagram for explaining a relationship between a content of an additive material of a phosphor layer and a discharge delay time.

FIG. 10 is a graph measuring a discharge delay time of an address discharge while a percentage of a volume of MgO material used as an additive material based on volume of the phosphor layer changes from 0% to 50%.

The address discharge delay time means a time interval between a time point when the scan signal and the data signal are supplied to the scan electrode and the address electrode during an address period, respectively and a time point when an address discharge occurs between the scan electrode and the address electrode.

As shown in FIG. 10, when the volume percentage of the MgO material is 0 (in other words, when the phosphor layer does not include MgO material), the discharge delay time may be approximately 0.8 μs.

When the volume percentage of the MgO material is 2%, the discharge delay time is reduced to be approximately 0.75 μs. In other words, because the particles of the MgO material improve a discharge response characteristic between the scan electrode and the address electrode, an address jitter characteristic can be improved.

Further, when the volume percentage of the MgO material is 5%, the discharge delay time may be approximately 0.72 μs. When the volume percentage of the MgO material is 6%, the discharge delay time may be approximately 0.63 μs.

When the volume percentage of the MgO material lies in a range between 10% and 50%, the discharge delay time may be reduced from approximately 0.55 μs to 0.24 μs.

It can be seen from the graph of FIG. 10 that as a content of the MgO material increases, the discharge delay time can be reduced. Hence, the address jitter characteristic can be improved. However, an improvement width of the address jitter characteristic may gradually decrease. In case that the volume percentage of the MgO material is equal to or more than 40%, a reduction width of the discharge delay time may be small.

On the other hand, in case that the volume percentage of the MgO material is excessively large, the particles of the MgO material may excessively cover the surface of the particles of the phosphor material. Hence, a luminance may be reduced.

Accordingly, the percentage of the volume of the MgO material based on the volume of the phosphor layer may lie substantially in a range between 2% and 40% or between 6% and 27% so as to reduce the discharge delay time and to prevent an excessive reduction in the luminance.

FIG. 11 shows another structure of a phosphor layer including particles of an additive material.

As shown in FIG. 11, the particles 1010 of the additive material may be positioned on the surface of the phosphor layer 114, inside the phosphor layer 114, and between the phosphor layer 114 and the lower dielectric layer 115.

When the particles 1010 of the additive material may be positioned on the surface of the phosphor layer 114, inside the phosphor layer 114, and between the phosphor layer 114 and the lower dielectric layer 115, a discharge response characteristic between the scan electrode and the address electrode or between the sustain electrode and the address electrode can be improved.

FIG. 12 illustrates an example of a method of manufacturing the phosphor layer 114 having the structure shown in FIG. 11.

As shown in FIG. 12, a powder of an additive material is prepared in step S1600.

The prepared additive power is mixed with phosphor particles in step S1610.

The additive power and the phosphor particles are mixed with a solvent in step S1620.

The additive power and the phosphor particles mixed with the solvent are coated inside the discharge cells in step S1630. In the coating process, a dispensing method may be used.

A dry process or a firing process is performed in step S1640 to evaporate the solvent. Hence, the phosphor layer having the structure shown in FIG. 11 is formed.

FIG. 13 is a diagram for explaining a method of selectively using an additive material in each discharge cell.

As shown in FIG. 13, the phosphor layer includes a red phosphor layer 114R emitting red light, a blue phosphor layer 114B emitting blue light, and a green phosphor layer 114G emitting green light. The additive material may be omitted in at least one of the red phosphor layer 114R, the hue phosphor layer 114B, or the green phosphor layer 114G.

For instance, as shown in (a) of FIG. 13, the red phosphor layer 114R includes particles 1200 of a red phosphor material, but does not include an additive material. As shown in (b)

of FIG. 13, the blue phosphor layer 114B may include particles 1210 of a blue phosphor material and particles 1010 of an additive material.

The structure of FIG. 13 may be applied to a case where the red phosphor layer 114R and the blue phosphor layer 114B have different electrical characteristics.

For instance, in case that the amount of charges accumulated on the surface of the blue phosphor layer 114B is less than the amount of charges accumulated on the surface of the red phosphor layer 114R, a discharge in the blue phosphor layer 114B may occur later than a discharge in the red phosphor layer 114R. However, in this case, because the hue phosphor layer 114B includes the particles 1010 of the additive material, a discharge can earlier occur in the blue phosphor layer 114B. Hence, the discharge can uniformly occur in the red phosphor layer 114R and the blue phosphor layer 114B.

In FIG. 13, (a) shows the particles 1200 of the red phosphor material, and (b) shows the particles 1210 of the blue phosphor material. The size of the particles 1210 of the blue phosphor material may be larger than the size of the particles 1200 of the red phosphor material. The size difference may be caused by a difference between components of the red and blue phosphor materials or a difference between manufacturing processes of the red and blue phosphor materials.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIGS. 8 and 9 are diagrams for explaining an effect of an additive material of a phosphor layer;

BEST MODE FOR CARRYING OUT THE INVENTION

Figure 1:
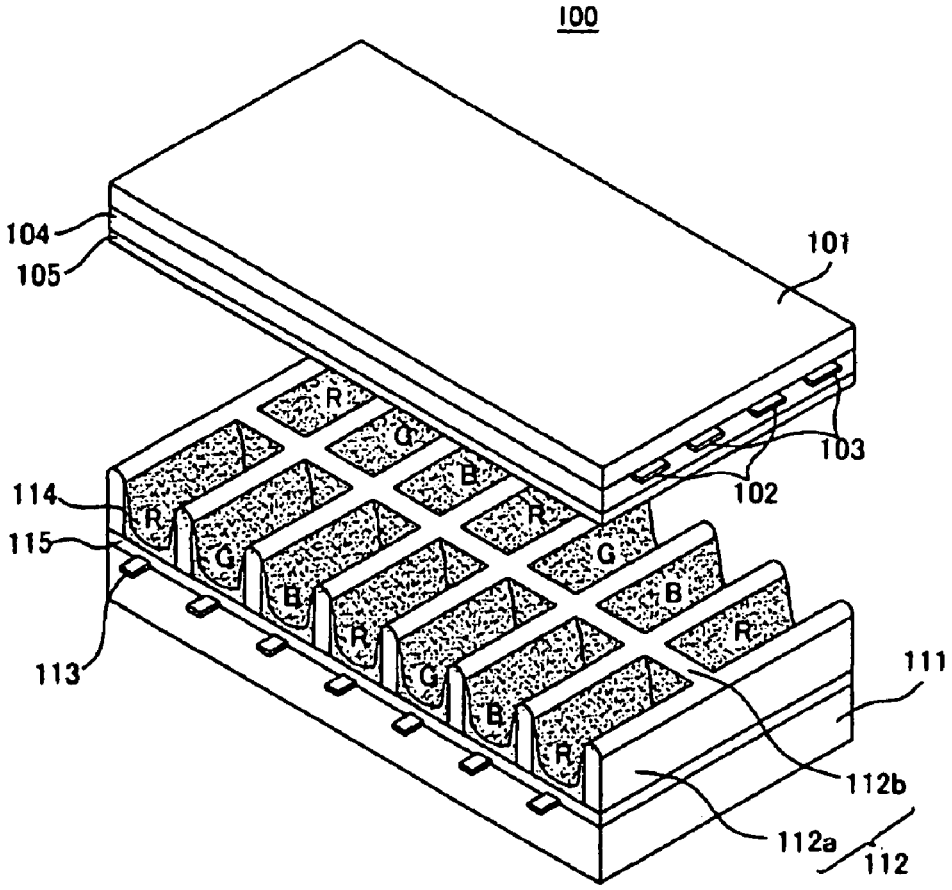
FIG. 1 is a diagram for explaining a structure of a plasma display panel.
Figure 2:
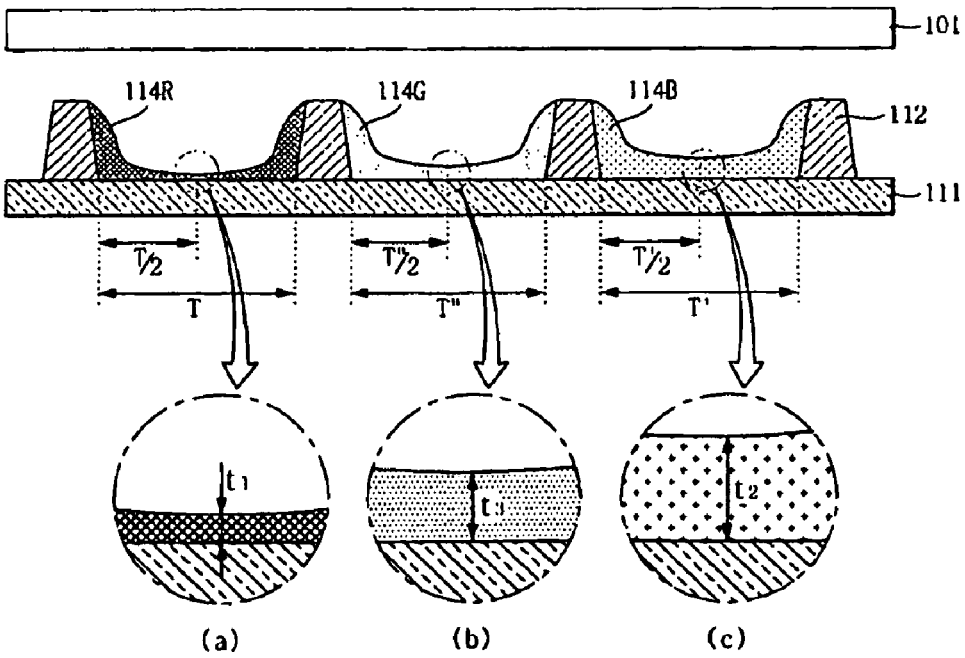
FIG. 2 is a diagram for explaining a thickness of a phosphor layer in each discharge cell.
Figure 3:
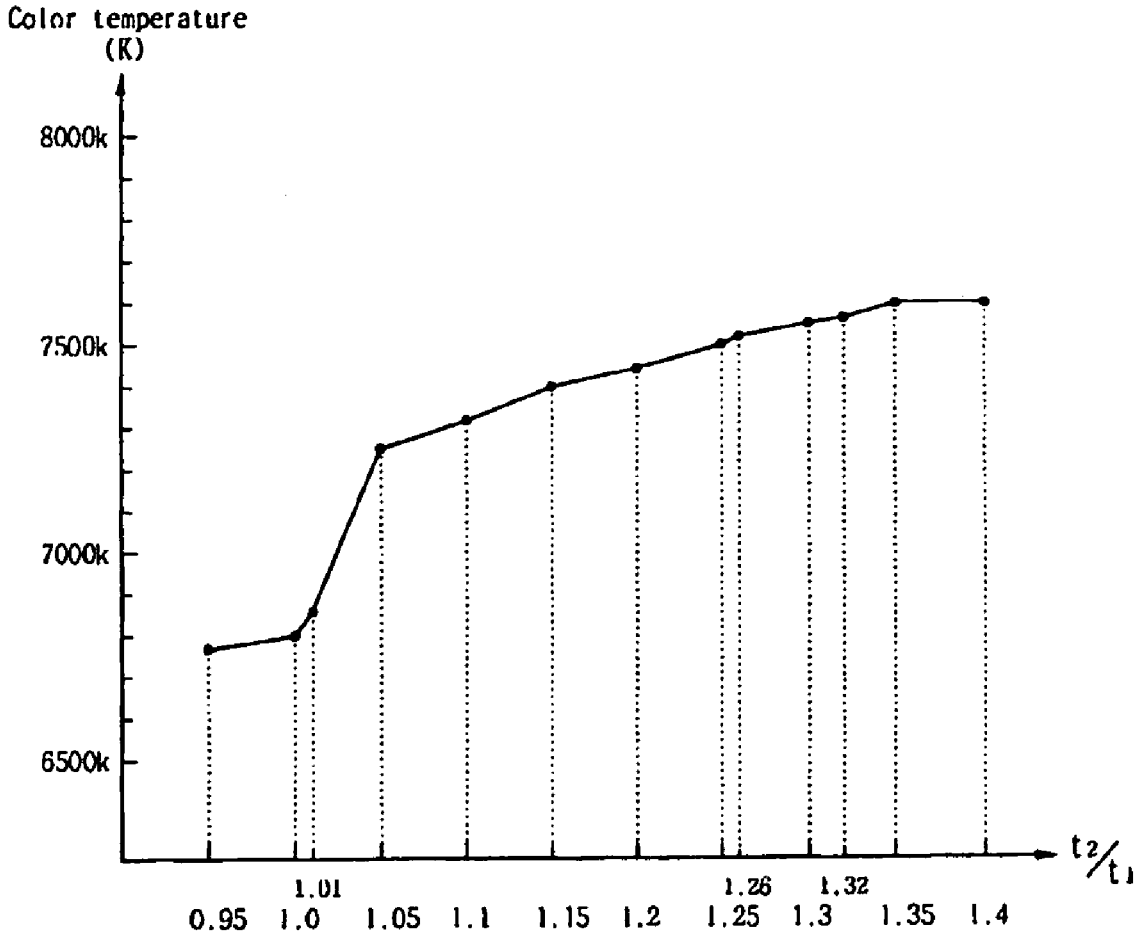
FIGS. 3 and 4 are diagrams for explaining a relationship between a thickness of a red phosphor layer and a thickness of a blue phosphor layer.
Figures 4, 5:
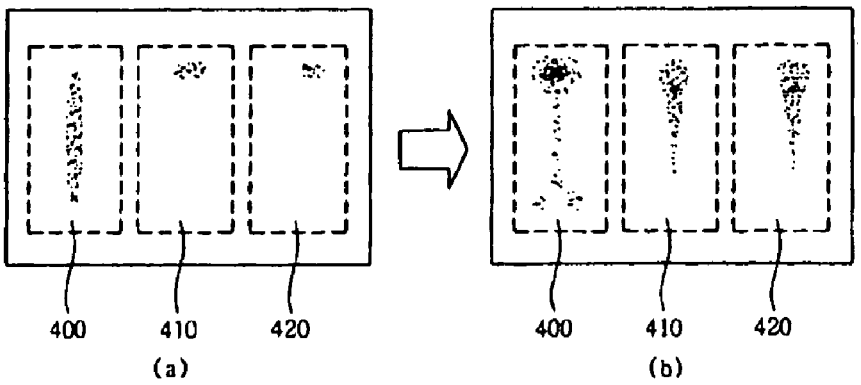
FIG. 5 is a diagram for explaining non-uniformity of discharges generated in discharge cells.
Figure 6:
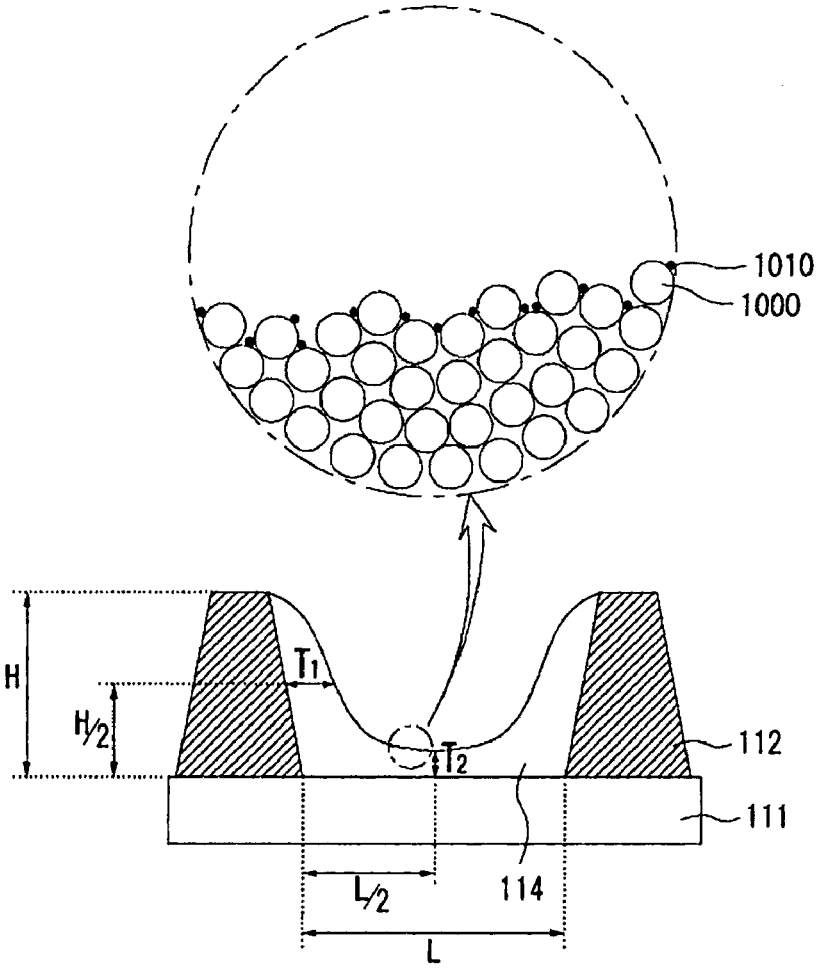
FIG. 6 is a diagram for explaining a phosphor layer including particles of an additive material.
Figure 7:
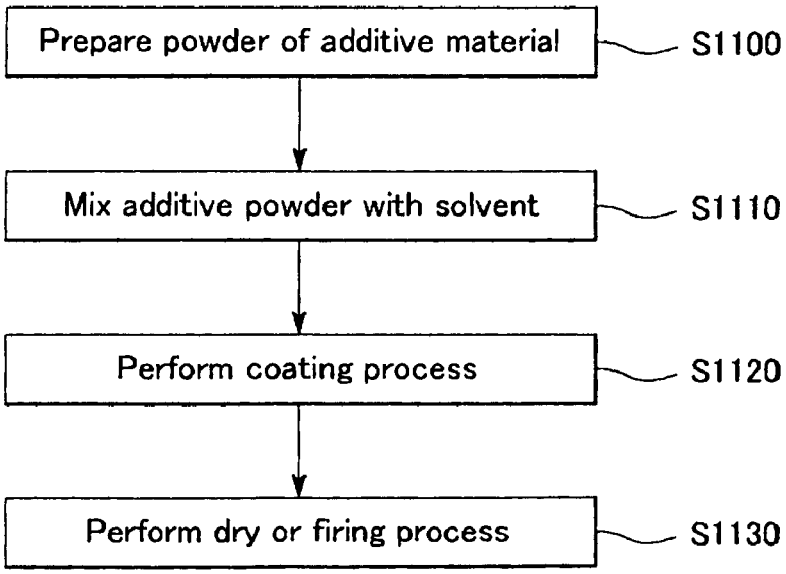
FIG. 7 illustrates an example of a method of manufacturing a phosphor layer including particles of an additive material.
Figure 9:
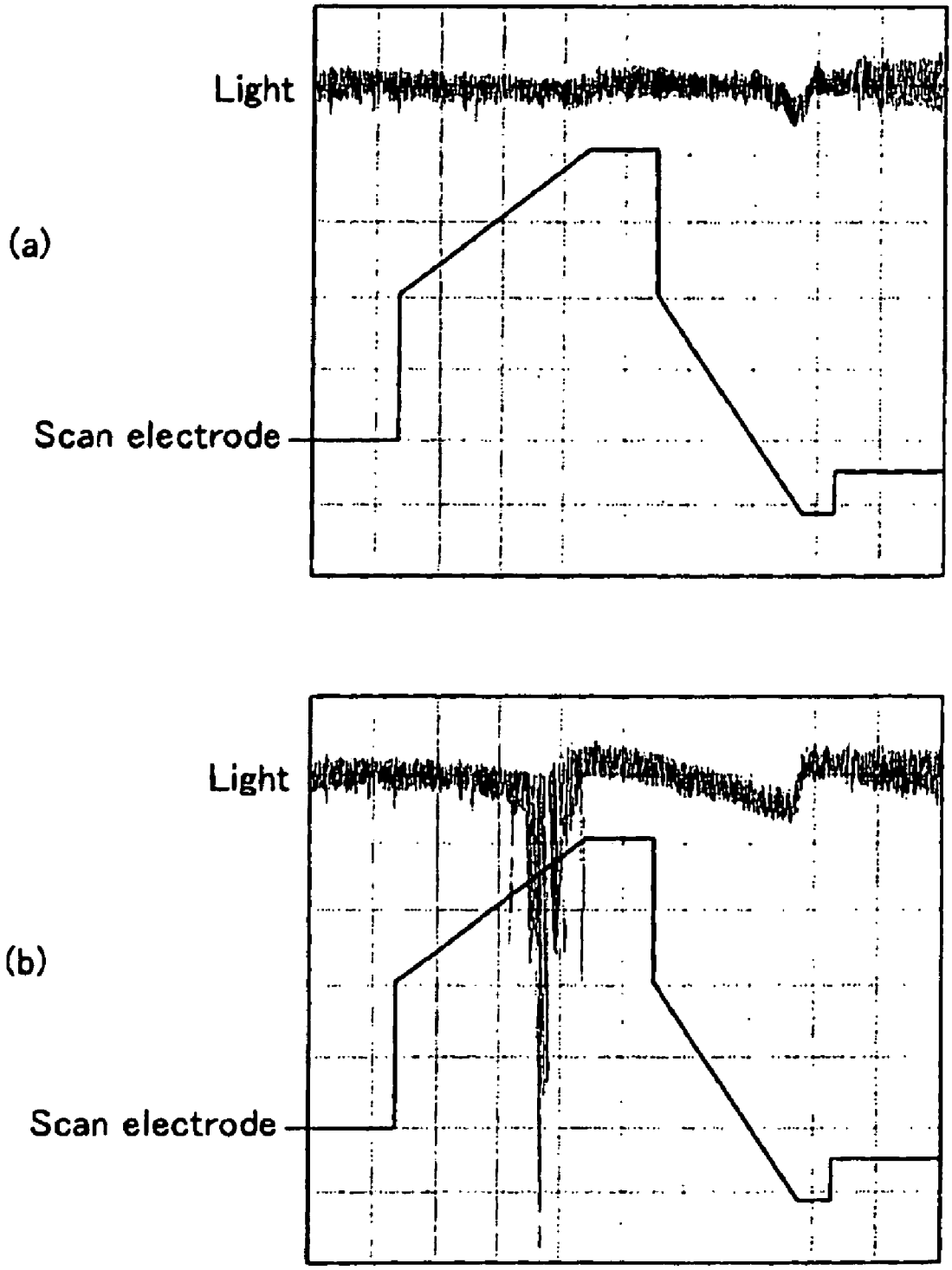
Figure 10:
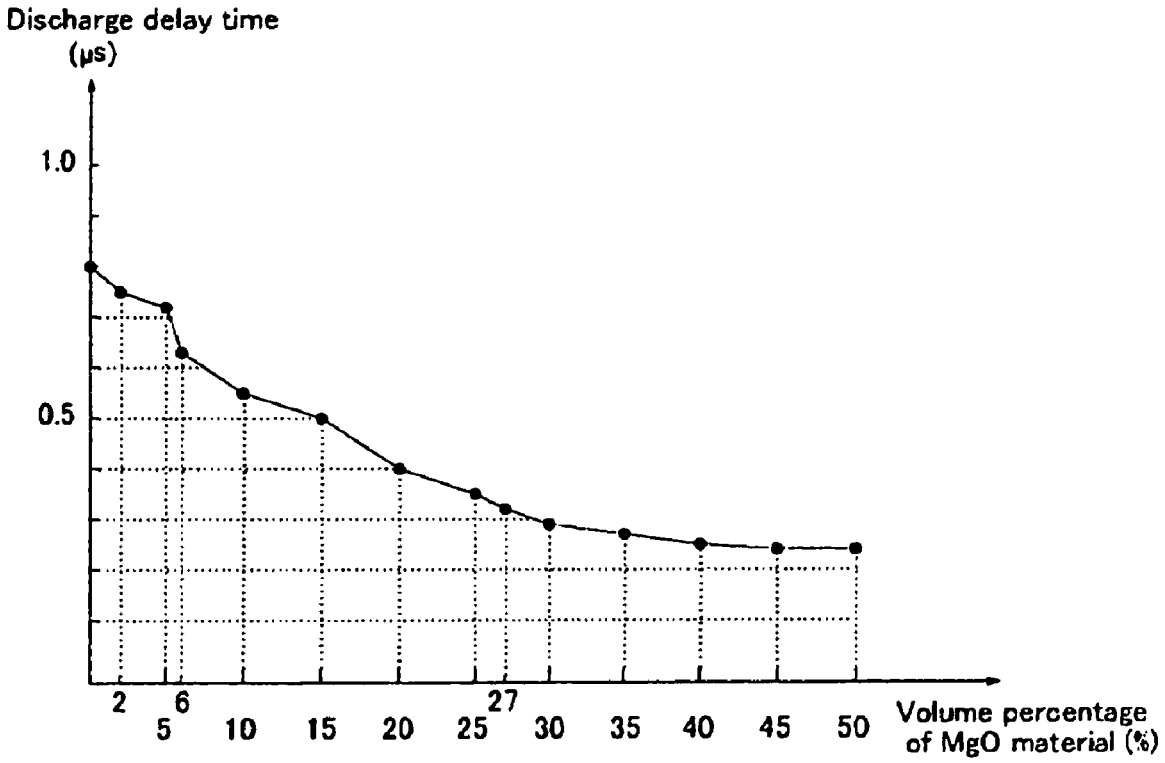
FIG. 10 is a diagram for explaining a relationship between a content of an additive material of a phosphor layer and a discharge delay time.
Figure 11:
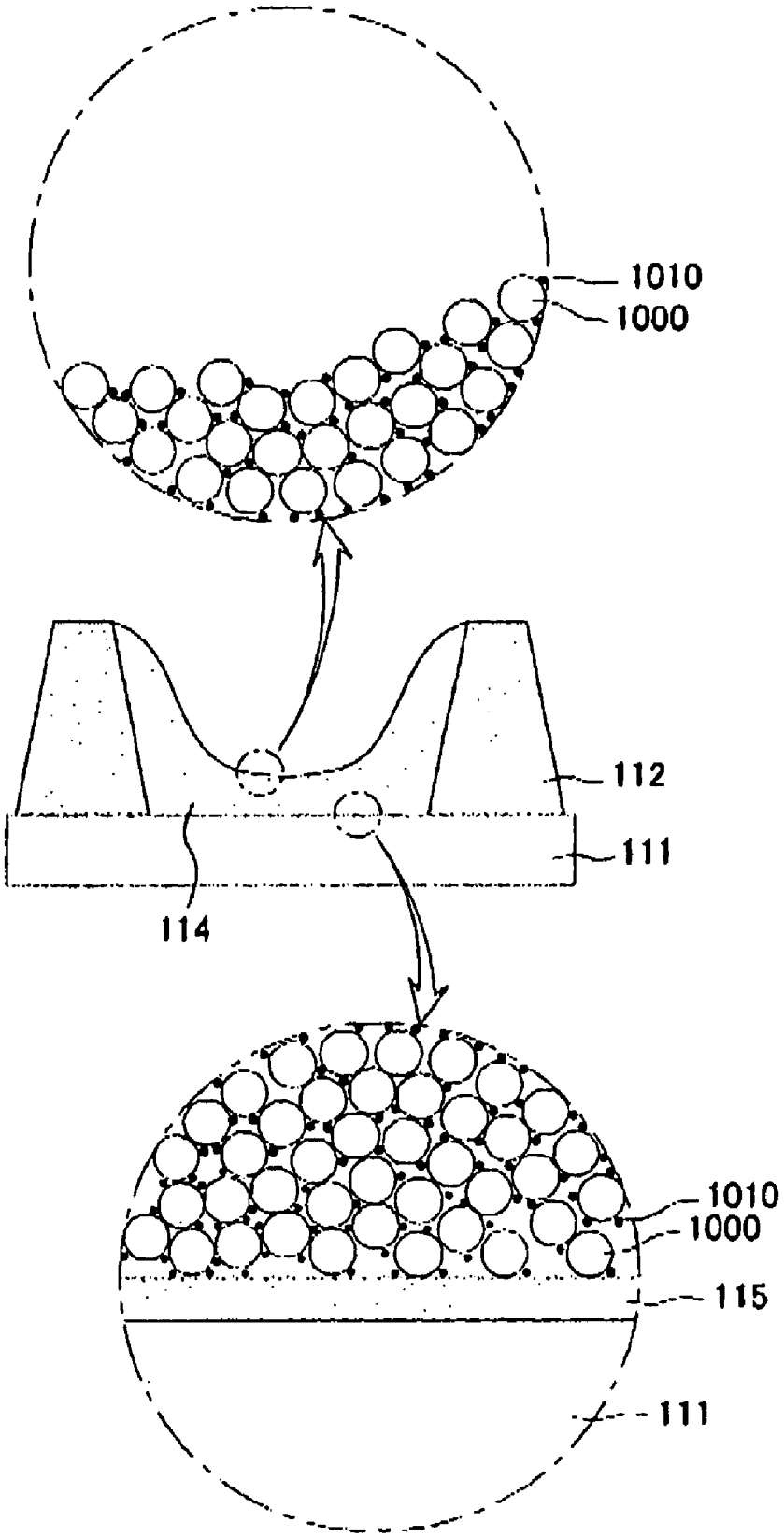
FIG. 11 shows another structure of a phosphor layer including particles of an additive material.
Figure 12:
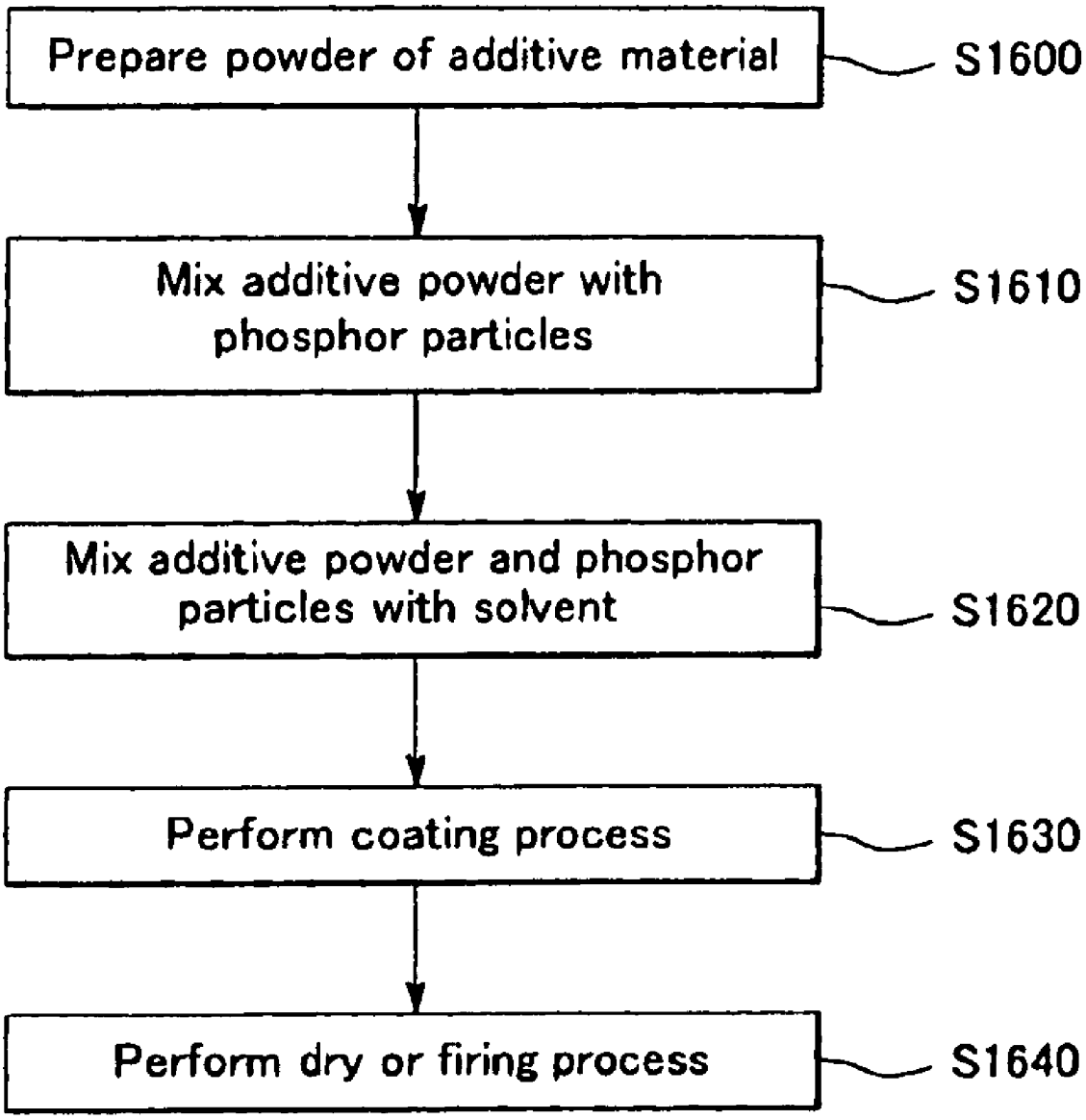
FIG. 12 illustrates another example of a method of manufacturing a phosphor layer including an additive material.
Figure 13:
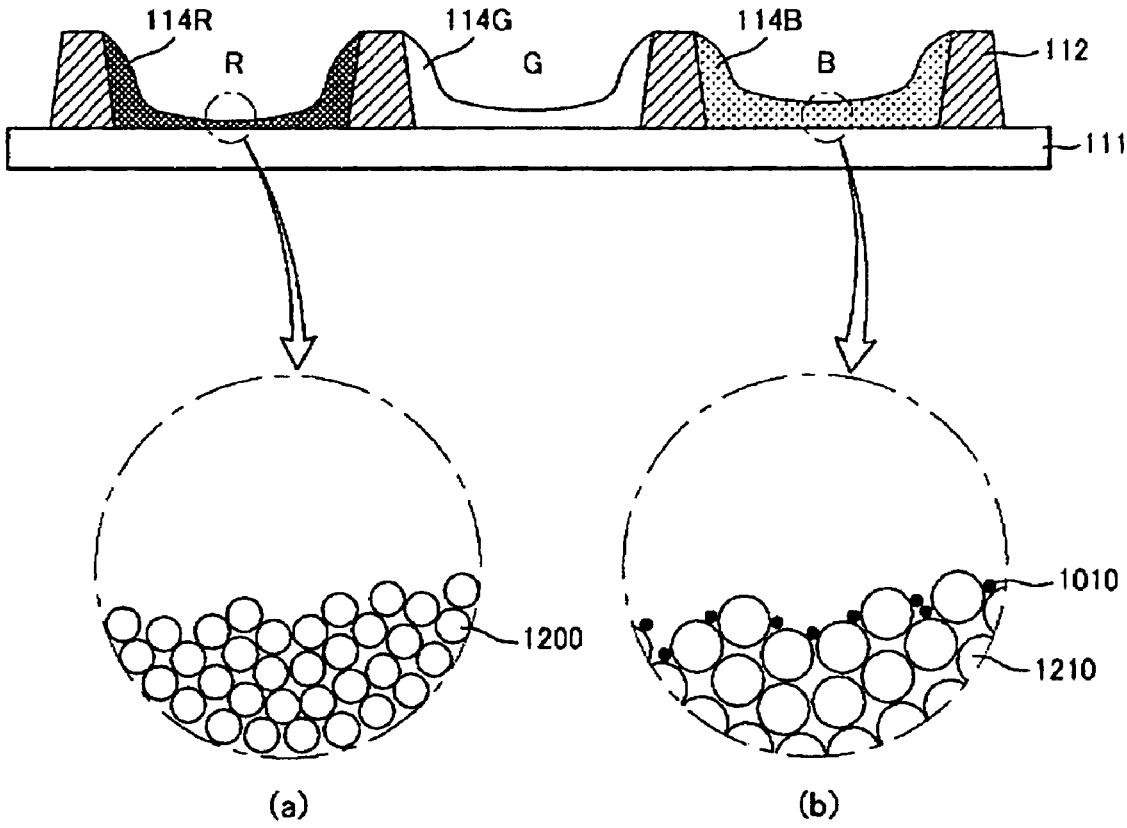
FIG. 13 is a diagram for explaining a method of selectively using an additive material in each discharge cell.

In one aspect, a plasma display panel comprises a front substrate, a rear substrate positioned to be opposite to the front substrate, a barrier rib positioned between the front substrate and the rear substrate to partition a discharge cell, and a phosphor layer positioned in the discharge cell, the phosphor layer including a phosphor material and an additive material, wherein the phosphor layer includes a red phosphor layer emitting red light, a green phosphor layer emitting green light, and a blue phosphor layer emitting blue light, and a thickness of the blue phosphor layer is larger than a thickness of the red phosphor layer.

In another aspect, a plasma display panel comprises a front substrate, a rear substrate positioned to be opposite to the front substrate, a barrier rib positioned between the front substrate and the rear substrate to partition a discharge cell, and a phosphor layer positioned in the discharge cell, the phosphor layer including a phosphor material and an additive material, wherein the phosphor layer includes a red phosphor layer emitting red light, a green phosphor layer emitting green light, and a hue phosphor layer emitting hue light, a thickness of the blue phosphor layer is larger than a thickness of the red phosphor layer, and a particle size of the blue phosphor layer is different from a particle size of the red phosphor layer.

The invention claimed is:

1. A plasma display panel comprising:

a front substrate on which a scan electrode and a sustain electrode are disposed;

a rear substrate, on which an address electrode is disposed, positioned to be opposite to the front substrate;

a barrier rib positioned between the front substrate and the rear substrate to partition a discharge cell; and a phosphor layer positioned in the discharge cell, the phosphor layer including a phosphor material and an additive material, wherein the phosphor layer includes a red phosphor layer emitting red light, a green phosphor layer emitting green light, and a blue phosphor layer emitting blue light, wherein a thickness of the blue phosphor layer is larger than a thickness of the red phosphor layer, wherein the blue phosphor layer includes a blue phosphor material and the red phosphor layer includes a red phosphor material, wherein a particle size of the blue phosphor material is larger than a particle size of the red phosphor material, wherein a height of the barrier rib is H, a pitch of the discharge cell is L, and a thickness of the phosphor layer measured at a location corresponding to one half of the height of the barrier rib (H/2) is larger than a thickness of the phosphor layer measured at a location corresponding to one half of the pitch of the discharge cell (L/2), wherein a ratio of the thickness of the blue phosphor layer to the thickness of the red phosphor layer lies in a range between 1.05 and 1.26, and the color temperature lies substantially in a range between 7,250K and 7,520K, wherein a percentage of a volume of the additive material based on a volume of the phosphor layer lies substantially in a range between 6% and 27%, and a discharge delay time is less than 0.63 μs, and wherein the discharge delay time is a time interval between a time point when a scan signal is supplied to the scan electrode and a data signal is supplied to the address electrode during an address period and a time point when an address discharge occurs between the scan electrode and the address electrode.

2. The plasma display panel of claim 1, wherein the additive material includes at least one of magnesium oxide (MgO), zinc oxide (ZnO), silicon oxide (SiO2), titanium oxide (TiO2), yttrium oxide (Y2O3), aluminum oxide (Al2O3), lanthanum oxide (La2O3), europium oxide (EuO), cobalt oxide, iron oxide, or CNT (carbon nano tube).

3. The plasma display panel of claim 1, wherein at least one of particles of the additive material is positioned on the surface of the phosphor layer.

4. The plasma display panel of claim 1, further comprising a lower dielectric layer between the phosphor layer and the barrier rib and the rear substrate, wherein at least one of particles of the additive material is positioned between the phosphor layer and the lower dielectric layer.

5. The plasma display panel of claim 1, wherein the additive material is omitted in at least one of the red phosphor layer, the green phosphor layer, and the blue phosphor layer.

* * * * *